US005989795A

United States Patent [19]

Evans et al.

[11] Patent Number: 5,989,795

[45] Date of Patent: Nov. 23, 1999

[54] PERFORMANCE OF PHOTOGRAPHIC EMULSIONS AT HIGH SILVER ION CONCENTRATIONS

[75] Inventors: Francis John Evans; Arthur Herman Herz, both of Rochester, N.Y.

[73] Assignee: Eastman Kodak Company, Rochester, N.Y.

[21] Appl. No.: 07/886,617

[22] Filed: May 21, 1992

Related U.S. Application Data

[63] Continuation-in-part of application No. 07/455,250, Dec. 22, 1989, abandoned.

[51] Int. Cl.[6] ..... G03C 1/492; G03C 1/10

[52] U.S. Cl. ..... 430/513; 430/577; 430/581; 430/603; 430/605; 430/608; 430/642

[58] Field of Search ..... 430/581, 577, 430/513, 567, 642, 603, 605, 608, 517, 522

[56] References Cited

U.S. PATENT DOCUMENTS

| | | | |
|---|---|---|---|
| 2,493,748 | 1/1950 | Brooker et al. | 430/577 |
| 3,271,157 | 9/1966 | McBride . | |
| 3,647,460 | 3/1972 | Hofman et al. | 430/513 |
| 4,590,155 | 5/1986 | Klotzer . | |
| 5,057,406 | 10/1991 | Usagawa et al. | 430/513 |

OTHER PUBLICATIONS

Photographic Science Eng., 16, 1972, p. 413.
The Theory of the Photographic Process, 4th Edition, 1977, pp. 25–37.
Research Disclosure No. 15560, Mar. 1977.
W. L. Gardner et al, "Society of Photographic Scientists & Engineers", 1977, pp. 325–330.
T. H. James, "The Theory of the Photographic Process", 1977, pp. 156–158.
R. W. Swenson et al, "Photographic Science & Technique", 1956, pp. 162–166.
Research Disclosure No. 17643, Dec. 1978, pp. 22–31.

*Primary Examiner*—Thorl Chea
*Attorney, Agent, or Firm*—Paul A. Leipold

[57] ABSTRACT

This invention relates to a photographic recording material comprising a support and a photosensitive chemically sensitized silver halide emulsion layer, containing a sensitizing dye selected from the group consisting of oxonal dyes, merocyanine dyes, and cyanine dyes having a net negative charge, and which has a pH value between about 2 to about 5 and a pAg value between about 1 to about 4.7.

18 Claims, No Drawings

PERFORMANCE OF PHOTOGRAPHIC EMULSIONS AT HIGH SILVER ION CONCENTRATIONS

This application is a Continuation-in-Part of U.S. application Ser. No. 455,250 filed Dec. 22, 1989, now abandoned.

This invention relates to a photographic recording material and more particularly to a recording having coated thereon a silver halide emulsion layer which has improved resistance to fog, particularly on storage prior to use, while maintaining desired photographic speed and exhibiting reduced sensitizing dye stain after processing.

In early photographic monochrome systems, any sensitizing dye retained in photographic materials following the developing and fixing process, was of little consequence. However, in modern film applications requiring elevated levels of spectral sensitizers, dye stain becomes an objectionable defect. Particularly tabular grain emulsions with their high specific surface areas, require high levels of sensitizing dye both for black and white and for color film applications. Similarly, chloride-rich silver halide emulsions, which are often favored for color paper formulations, use high sensitizing dye concentrations for optimum photographic performance. In such systems with high sensitizing dye levels, stain from residual sensitizing dye is further aggravated by trends in the photographic industry towards ever shorter process cycles; that trend diminishes the time available for sensitizing dye to diffuse from the photographic material into process or wash solutions.

For overcoming this stain from retained sensitizing dyes, previous approaches involved the incorporation in the photographic material of dye solvents or dye deaggregants or, as in U.S. Pat. No. 5,091,298, the use of spectral sensitizing dyes containing specific substituents. However, in actual practice, none of these approaches proved to be entirely satisfactory. Hence, the search has continued for dyes which, in a specified emulsion environment, are adsorbed to silver halide grains as effective spectral sensitizers but which are removed from the photographic material during processing either because they undergo a chemical decolorization reaction or because they desorb from the silver halide and, due to their solubility, diffuse out of the emulsion layers.

As a result of this investigation, it was found that anionic cyanines, which tend to wash out of photographic materials during processing and thus minimize dye stain, proved to be surprisingly active spectral sensitizers when coated in an emulsion environment of elevated acidity (low pH) and high silver ion activity (low pAg). This particular emulsion environment also strongly improved spectral sensitization from oxonol and merocyanine dyes. Further, members of these classes which were previously incorporated in conventional silver halide emulsion systems as non-sensitizing but process-bleachable filter dyes were unexpectedly converted to excellent spectral sensitizers when coated in a low pH and low pAg emulsion environment and left no dye stain after the process cycle of development, fixation, and washing.

It is well known to manufacture silver halide emulsions under acidic conditions. For example, U.S. Pat. No. 3,271,157 describes manufacture and coating of silver halide emulsions at pH values below about 5, for example, at values as low as pH 2.0. Such conventional low pH emulsions contain excess soluble halide ions and have pAg values of at least 8. One of the effects of low pH manufactured and coated silver halide emulsions is greater resistance to fog formation, although this is frequently offset by loss of desirable photographic speed and increased latent image instability.

Little information is available on how pAg variations influence sensitometric properties. In one study by Collier and Gilman (Photogr. Sci. Eng., 16, 413, 1972), silver bromide emulsions which had not been chemically sensitized, were examined at pH 4 over the range pAg 10 to 3, both in the absence and presence of cationic cyanine iodides. As reported in *The Theory of the Photoaraphic Process*, 4th Ed., Macmillan Publishing Co., New York, 1977, pp. 25–37, these pAg values cover a range where the chemically non-sensitized silver bromide emulsions contained an excess of either soluble halide ions or soluble silver ions. Collier and Gilman observed an increase in the ratio between spectral sensitivity and sensitivity at 400 nm when pAg was lowered from about pAg 10 to pAg 7, and that this ratio remained essentially constant with further pAg decreases. However, at low pAg values, cyanine deaggregation was noted and fog became apparent. The changed response of the initially chemically non-sensitized silver bromide was ascribed to formation of metallic silver.

It is also well established in the photographic literature that for emulsions which were previously chemically sensitized, an exposure to low pAg conditions promotes both instability and fog formation. An example of this behavior is furnished in *Research Disclosure* No. 15560, March, 1977, Published by Kenneth Mason Publications, Ltd., The Old Harbourmaster's, 8 North Street, Emsworth, Hampshire, PO10 7DD, England, the disclosure of which is herein incorporated by reference. This publication shows that a chemically sensitized silver bromide emulsion in the absence or presence of cationic or zwitterionic (neutral) cyanine spectral sensitizer coated at pH 5.6 and pAg 5.0 exhibited substantial fog whereas the same emulsion coated at either pH 2 and pAg 5 or pH 5.6 and pAg 8.2, did not undergo this fogging reaction.

It is also known from *Research Disclosure* No. 17643, December, 1978, and from Klotzer's U.S. Pat. No. 4,590,155 (1986) that it is possible to chemically sensitize silver halide emulsions in broad ranges from about pH 3 to about 9 and from about pAg 4 to about 10. However, pH and pAg conditions for chemical sensitization do not necessarily relate to eventual coating conditions. Moreover, there is no indication that the prior art contemplated the advantageous use of chemically sensitized emulsions containing removable or bleachable sensitizing dyes in a specific coating environment involving simultaneously both a low pH and a low pAg condition.

It is an object of the present invention to provide a photographic recording material which has improved resistance to storage fog, which is capable of providing the desired or increased photographic speed and which displays no stain as a result of spectral dye sensitization.

The present invention provides a photographic recording material comprising a support and a photosensitive chemically sensitized silver halide emulsion layer which contains between 10 to 0.01 mM (millimolar) excess protons, which corresponds to a pH value of 2 to 5.0, and between 100 and 0.02 mM excess silver ions which corresponds to pAg values of 1 to 4.7; the preferred range being between pAg 3 to 4.7 with values having particular preference being 3.7 to 4.1.

The low pH and low pAg emulsions yield advantageous sensitivity when they have incorporated therein removable or process-bleachable sensitizing dyes belonging to the class of cyanines, merocyanines or oxonols, their structure is noted below.

The photographic silver halide emulsions may be formed and chemically sensitized by any method known in the prior art. Such emulsions may also contain art-recognized additives such as dye supersensitizers, ionic, or non-ionic development modifiers and hardening agents, specifically included as hardeners are aluminum salts and complexes.

Adjustment of the final acidity between the values of pH 2 and pH 5 can be made with inorganic or organic acids and bases exemplified by sulfuric, nitric, methanesulfonic, benzenesulfonic or trifluoroacetic acids and by sodium hydroxide, tetramethylammonium hydroxide and the like.

Similarly, the adjustments to pAg values between 1 and 5.7 can be made with inorganic or organic silver salts such as silver nitrate, silver perchlorate, silver benzenesulfonate and the like.

Preferably, the silver halide emulsions are coated at a pH value from 2 to 4 and at a pAg value from 3 to 4.7. These emulsions can be comprised of silver bromide, silver chloride, silver iodide, silver chlorobromide, silver chloroiodide, silver bromoiodide, silver chlorobromoiodide or other mixed compositions of these halides. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al U.S. Pat. No. 4,434,226, Daubendiek et al U.S. Pat. No. 4,414,310, Wey U.S. Pat. No. 4,399,215, Solberg et al U.S. Pat. No. 4,433,048, Mignot U.S. Pat. No. 4,386,156, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,643,966 and Daubendiek et al U.S. Pat. Nos. 4,672,027 and 4,693,964. Also specifically contemplated are those silver bromoiodide grains with a higher molar proportion of iodide in the core of the grain than in the periphery of the grain, such as those described in British Patent 1.027,146; Japanese Published Application 54/48,521; U.S. Pat. Nos. 4,379,837; 4,444,877; 4,665,012; 4,686,178; 4,565,778; 4,728,602; 4,668,614; 4,636,461 and European Patent 264,954. The silver halide emulsions can be either monodisperse or polydisperse as precipitated. The grain size distribution of the emulsions can be controlled by silver halide grain separation techniques or by blending silver halide emulsions of differing grain sizes.

The silver halide emulsions can be chemically sensitized. Noble metals (e.g., gold), Group VIII compounds, middle chalcogens (e.g., sulfur, selenium, or tellurium), copper, thallium, lead, bismuth or cadmium may be used. Reduction sensitization is also specifically contemplated. Typical chemical and spectral sensitizers are listed in *Research Disclosure* Item 17643, 1978, Sections III and IV published by Kenneth Mason Publications, Ltd., The Old Harbourmaster's, 8 North Street, Emsworth, Hampshire, PO10 7DD, England, the disclosures of which are incorporated herein by reference. This publication will be identified hereafter by the term "*Research Disclosure*".

The emulsions can be surface-sensitive, i.e., emulsions that form latent images primarily on the surfaces of the silver halide grains, or internal latent image-forming emulsions, i.e., emulsions that form latent images predominantly in the interior of the silver halide grains. The emulsions can be negative-working, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

As noted above, the silver halide emulsions disclosed herein can be spectrally sensitized with dyes of various classes, including cyanines, merocyanines, and oxonols. The preferred dyes are those whose sensitizing activity is improved by the low pH and low pAg emulsions of this invention and which are either removed or bleached during photographic processing. Use of these spectral sensitizers minimizes stain or coloration in the processed material from residual sensitizing dye.

Cyanines, having a net negative charge, which in solution contain more negative than positive charges per dye molecule, i.e., anionic cyanines, are particularly useful spectral sensitizers for the low pH and low pAg emulsions of this invention. Such anionic cyanines can be represented by various structures; some of these are shown schematically as A, B, and C for a disulfoethyl cyanine-type dye:

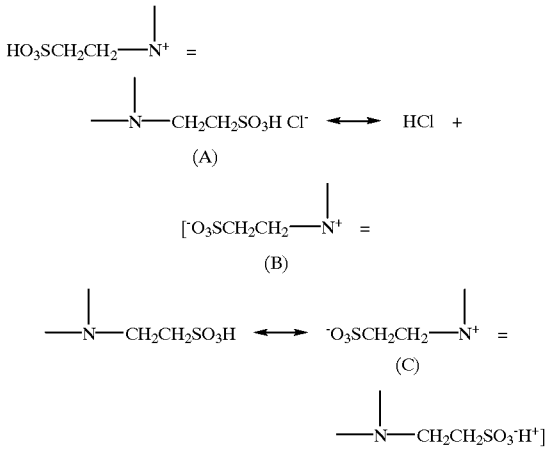

For the purpose of this invention, cyanine molecules A, B, and C are equivalent since at pH>2, they all produce the same dye anion. Such anionic cyanines are specially useful in the practice of this invention due to their superior sensitizing characteristics under the specified emulsion conditions and also because their relatively high solubility facilitates their removal from the silver halide surface during the process cycle, thereby leading to minimized dye stain. Earlier observations had already established that anionic cyanines are more feebly adsorbed to silver halide than their neutral (zwitterionic) or cationic analogs (cf. A. Herz, *Adv. Colloid Interface Sci.*, 8, 237, 1977).

Spectral sensitization by oxonol and merocyanine dyes is also powerfully enhanced by the low pH and low pAg conditions of this invention. Moreover, the utility of these dyes is further enhanced by their tendency to undergo decolorizing reactions in developers, thereby leading to processed coatings without dye stain.

In this connection it is relevant that oxonols and merocyanines are often incorporated in conventional silver halide emulsions containing excess soluble halide ions as "bleachable filter dyes" in order to control the spectral distribution of exposure. For this prior art purpose, these dyes must be largely inert as sensitizers, desensitizers, or foggants, and they must be readily decolorized or bleached during processing, for example, in the development or fixing step.

Because these previously recognized "bleachable filter dyes" were unexpectedly converted to effective spectral sensitizers in the low pH and low pAg environment of this invention, these dyes offer the particular advantage of yielding spectral sensitization which, after processing, lead to images without stain from residual sensitizing dye. Examples of dyes which were previously recognized as inert and bleachable filter dyes but which become highly effective spectral sensitizers under the low pH and low pAg conditions of the present invention and leave no objectionable stain upon processing, include the oxonol dyes described in U.S. Pat. Nos. 2,274,782; 3,647,460; 4,877,721; as well as the merocyanine dyes described in U.S. Pat. Nos. 2,493,747; 2,493,748; 2,526,693; 2,719,088; and 3,840,375; the disclosures in these cited patents are herein incorporated by reference.

The emulsions of this invention containing more than 0.01 mM protons in form of a soluble, dissociated acid and more than 0.01 mM silver ions in form of a soluble, dissociated silver salt, are used at concentrations that can vary between 0.001 to 5 mole silver halide/liter. The amounts of oxonols, merocyanines, and anionic cyanines generally range between 0.05 to 2.0 mmole/mole silver. Gelatin is the preferred colloid and vehicle for the photosensitive silver halide emulsion of the present invention, although other vehicles can also be used like those listed in Section IX of *Research Disclosure*, No. 308115, December, 1989, the disclosures of which are herein incorporated by reference.

The silver halide emulsions of this invention may contain ionic antifoggants and stabilizers exemplified by palladium salts and complexes, like those described in German Patent DBP 1,157,077, by substituted thiazolium salts and their hydrolysis products described in U.S. Pat. Nos. 3,954,478; 4,423,140; 4,374,196; 4,578,348; and in European Patent Application 0,250,740 A2 and by the thiosulfonate salts disclosed in East German Patent 7376 and in U.S. Pat. No. 2,394,198. Also included among the ionic antifogging stabilizers are acidic compounds like hydroxyazaindenes, tetrazoles, and mercapto-substituted compounds exemplified by mercapto phenyltetrazole. Although ionic disulfides and diselenides with acidic substituents as described in U.S. Pat. Nos. 2,948,612; 3,043,696; 3,062,654; and 3,057,725 are ionic stabilizers which can be advantageously applied in the silver halide emulsions of this invention, their non-ionic analogs, like those described in U.S. Pat. No. 3,397,986 have similar utility for this purpose. Also specifically included as non-ionic antifoggants and stabilizers for the emulsions of this invention are the hydroxycarboxylic acid derivatives of W. Humphlett in U.S. Pat. No. 3,396,028 and the polyhydroxyalkyl compounds of U.S. patent application Ser. No. 493,598 entitled "Stabilization of Photographic Recording Materials" to Lok and Herz. Other antifoggants and stabilizers as described on page 26, in the Research Disclosure noted above, hardeners and coating aids as described on pages 26 and 27, and other layers and components of the photographic elements such as vehicles and extenders which are described on pages 25 to 27 of this Research Disclosure can be incorporated in the photographic elements by the procedures as described therein.

The photographic material described in the present invention can be processed with black and white developing agents like hydroquinones, 3-pyrazolidones, or other compounds such as those disclosed in Section XX of *Research Disclosure*, No. 308119, December, 1989, hereby incorporated by reference. Primary aromatic amine color developing agents exemplified by 4-amino-N-ethyl-N-hydroxyethylaniline can also be employed. Other suitable color developing agents are described in L. Mason, *Photoaraphic Processina Chemistry*, Focal Press, 1966, pp. 226–229.

The photographic emulsion system of this invention can contain color image forming couplers, i.e., compounds capable of reacting with an oxidation product of the color developing agent to form a dye. It can also contain colored couplers or development inhibitor-releasing (DIR) couplers. Suitable couplers are disclosed in Section VII of the cited 1989 *Research Disclosure*, hereby incorporated by reference.

When used for color photographic applications, the emulsions of this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The photographic emulsions of the present invention can be applied to a variety of photographic material, such as black and white films, films for graphic arts application, X-ray films and multilayer color films, including those having diffusion transfer applications.

The supports for the photographic materials used in this invention can be any material, as long as it does not deleteriously affect the photographic properties of the material and is dimensionally stable. Typical flexible sheet materials are described on page 28 of the December, 1978 edition of Research Disclosure noted above.

The term "nondiffusing" used herein has the meaning commonly applied to the term in photography and denotes materials that for all practical purposes do not migrate or wander through organic colloid layers, such as gelatin, in the photographic elements of the invention in an alkaline medium.

The term "associated therewith" is intended to mean that the materials can be in either the same or different layers, so long as the materials are-accessible to one another.

Table I below shows examples of typical oxonol dyes having the generic structure:

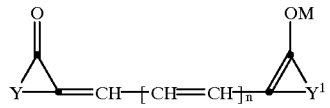

where n is 0, 1 or 2; M is hydrogen, an onium cation or an inorganic cation; and the letters Y and $Y^1$ represent the atoms necessary for completion of a 5 or 6-membered heterocycle.

In order to make these spectrally sensitizing oxonol dyes bleachable in photographic processing solutions and thus obtain images without stain from residual sensitizing dye, the heterocyclic residue represented by Y and $Y^1$, which can be the same or different, is preferably a rhodanine, thiohydantoin or thiazolidinedione or more preferably comprises a pyrazolone, isoxozolone, pyrandione, barbituric or thiobarbituric acid group. These and other suitable groups are illustrated as "Acidic Heterocycles" in *The Theory of the Photographic Process*, ed. T. H. James, Fourth Ed., Macmillon Publishing Co., New York, 1977, Chapter 8.

TABLE I

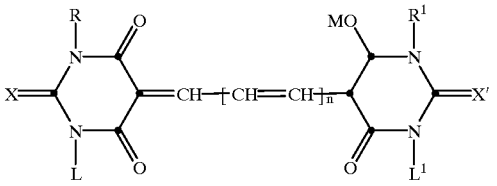

| Dye Compound | n | R | L | R' | L' | X | X' |
|---|---|---|---|---|---|---|---|
| I-1 | 1 | $C_2H_5$ | $C_2H_5$ | $C_2H_5$ | $C_2H_5$ | S | S |
| I-2 | 1 | $C_4H_9$ | $CH_2CO_2M$ | $C_4H_9$ | $CH_2CO_2M$ | O | O |
| I-3 | 1 | $C_5H_{10}CO_2M$ | $C_5H_{10}CO_2M$ | $C_2H_5$ | $C_5H_{10}CO_2M$ | O | S |
| I-4 | 1 | $C_5H_{10}CO_2M$ | $C_5H_{10}CO_2M$ | $C_5H_{10}CO_2M$ | $C_5H_{10}CO_2M$ | S | S |

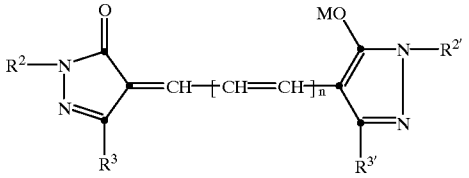

| Dye Compound | n | $R^2$ | $R^3$ | $R^{2'}$ | $R^{3'}$ |
|---|---|---|---|---|---|
| I-5 | 0 | $C_6H_5SO_3M(p)$ | $CH_3$ | $C_6H_5SO_3M(p)$ | $CH_3$ |
| I-6 | 1 | $C_6H_5SO_3M(p)$ | $CH_3$ | $C_6H_5SO_3M(p)$ | $CH_3$ |

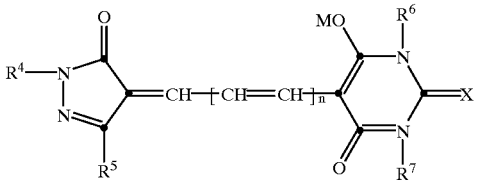

| | n | $R^4$ | $R^5$ | $R^6$ | $R^7$ | X |
|---|---|---|---|---|---|---|
| I-7 | 0 | $C_6H_5$ | $C_2H_5$ | $C_2H_5$ | $C_2H_5$ | S |
| I-8 | 1 | $C_6H_5$ | $C_2H_5$ | $C_2H_5$ | $C_2H_5$ | S |

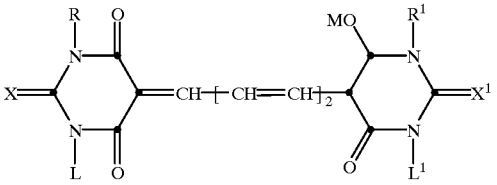

| Dye Compound | R | L | $R^1$ | $L^1$ | X | $X^1$ |
|---|---|---|---|---|---|---|
| I-9 | $C_6H_5$ | $C_6H_5$ | $C_6F_5$ | $C_6H_5$ | O | O |
| I-10 | $C_4H_9$ | $CH_2CO_2M$ | $C_4H_9$ | $CH_2CO_2M$ | O | O |
| I-11 | $C_5H_{10}CO_2M$ | $C_5H_{10}CO_2M$ | $C_5H_{10}CO_2M$ | $C_5H_{10}CO_2M$ | S | S |

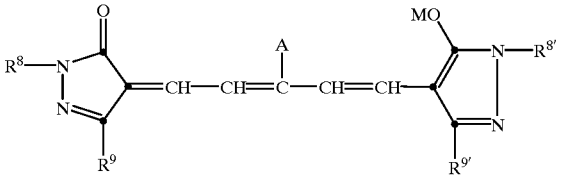

| | $R^8$ | $R^9$ | $R^{8'}$ | $R^9$ | A |
|---|---|---|---|---|---|
| I-12 | $(CH_2)_3SO_3M$ | $CH_3$ | $(CH_2)_3SO_3M$ | $CH_3$ | H |

TABLE I-continued

| | | | | | |
|---|---|---|---|---|---|
| I-13 | $C_6H_5$ | $CH_3$ | $C_6H_5$ | $CH_3$ | H |
| I-14 | $C_6H_5SO_3M(p)$ | $CH_3$ | $C_6H_5SO_3M(p)$ | $CH_3$ | H |
| I-15 | $C_6H_5SO_3M(p)$ | $CH_3$ | $C_6H_5SO_3M(p)$ | $CH_3$ | $CH_3$ |
| I-16 | $C_6H_5SO_3M(p)$ | $CO_2C_2H_5$ | $C_6H_5SO_3M(p)$ | $CO_2C_2H_5$ | H |
| I-17 | $C_6H_5SO_3M(p)$ | $CO_2M$ | $C_6H_5SO_3M(p)$ | $CO_2M$ | H |
| I-18 | $C_6H_5(SO_3M)_2$* | $CH_3$ | $C_6H_5(SO_3M)_2$* | $CH_3$ | H |
| I-19 | | $O{=}CCH_3$ | | $O{=}CCH_3$ | H |

*2,5-disubstituted

In Table I above R, $R^1$, $R_2$, $R^{2'}$, $R^3$, $R^{3'}$, $R^4$, $R^5$, $R^6$, $R^7$, $R^8$, $R^{8'}$, $R^9$ and $R^{9'}$, which may be the same or different, are alkyl groups having from 1 to about 10 carbon atoms which may be unsubstituted or substituted or aryl groups having from 6 to about 10 carbon atoms which may be unsubstituted or substituted.

Substituents which may be present on the alkyl or aryl groups include carboxylic, ester, ether, ketone, amide, sulfonamide, or sulfonate;

M is as defined above;

X and X' are oxygen or sulfur;

A is hydrogen or alkyl having from 1 to 3 carbon atoms; and

L and L' are as defined above for $R^1$ to $R^{9'}$.

The following Tables IIA and IIB illustrate examples of merocyanine dyes suitable for use in this invention. The illustrated examples have the general formula:

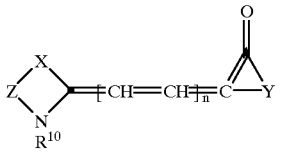

wherein n and Y are as defined above;

Z represents the atoms necessary to form a 5- or a 6-membered heterocycle;

X is a divalent link illustrated by Group VI elements, by $NHR^{11}$, or by the groups —CH═CH— or —$CH_2$—, —$CR_2$—; and $R^{10}$ and $R^{11}$ represent hydrogen or a hydrocarbon residue having from 1 to about 18 carbon atoms either of which may be further substituted with oxygen, sulfur or nitrogen-containing functions.

In order to make these spectrally sensitizing merocyanine dyes bleachable in photographic processing solutions and thus obtain images without stain from residual sensitizing dye, the preferred divalent link X is oxygen and the heterocyclic residue represented by Y is preferably a pyrazolone, isoxozolone, pyrandione, pyrazolidinedione, barbituric or thiobarbituric acid.

TABLE IIA

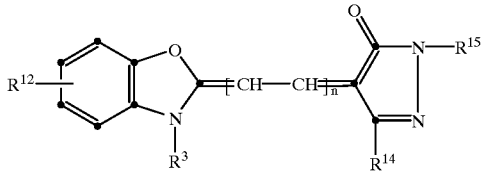

| Dye Compound | $R^7$ | $R^{13}$ | n | $R^{14}$ | $R^{15}$ |
|---|---|---|---|---|---|
| II-1 | H | $C_2H_5$ | 1 | $CH_3$ | $C_6H_5SO_3M(p)$ |
| II-2 | H | $C_2H_5$ | 2 | $CH_3$ | $C_6H_5SO_3M$ |
| II-3 | $SO_3M$ | $C_2H_5$ | 2 | $CH_3$ | $C_6H_5SO_3M(p)$ |
| II-4 | H | $C_2H_5$ | 2 | $CH_3$ | $C_6H_5NHSO_2C_6H_5(p)$ |
| II-5 | H | $C_2H_5$ | 2 | $CH_3$ | $C_6H_5$ |
| II-6 | H | $C_2H_5$ | 2 | $CH_2CO_2M$ | $C_6H_5$ |

TABLE IIB

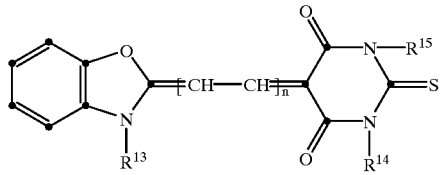

| Dye Compound | n | $R^{15}$ | $R^{14}$ | $R^{13}$ |
|---|---|---|---|---|
| II-7 | 1 | $C_2H_5$ | $C_2H_5$ | $(CH_2)_3SO_3Na$ |
| II-8 | 2 | $C_4H_9$ | $C_4H_9$ | $(CH_2)_3SO_3Na$ |
| II-9 | 2 | $C_5H_{10}CO_2H$ | $C_5H_{10}CO_2H$ | $(CH_2)_3SO_3Na$ |

wherein:

$R^{11}$ is hydrogen or alkyl or from 1 to about 12 carbon atoms which may be substituted;

$R^{12}$, $R^{13}$, and $R^{14}$ represent hydrogen or alkyl of from 1 to about 12 carbon atoms which may be substituted; and $R^{15}$ is aryl of from 6 to about 10 carbon atoms which may be substituted.

Further specific examples of compounds of Tables IIA and IIB are shown below.

II-10

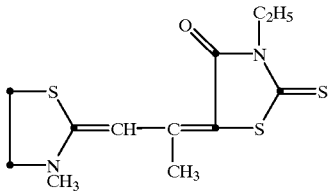

-continued

II-11

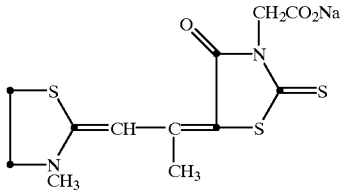

II-12

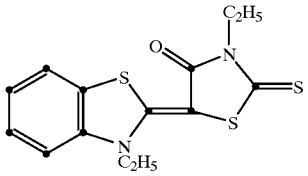

II-13

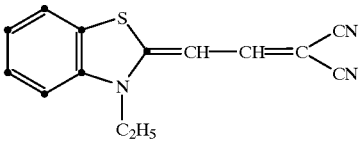

II-14

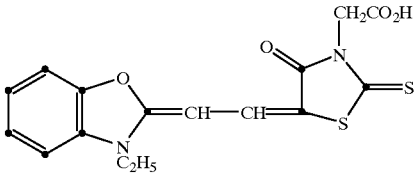

II-15

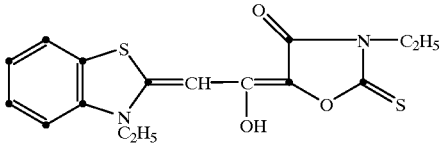

-continued

II-16

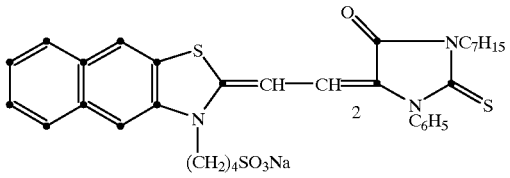

Table III illustrates anionic cyanine dye molecules of the following structure:

Q

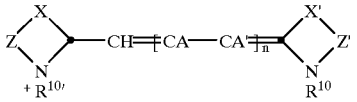

where n, $R^{10}$, A, X and Z are as described above; A' is hydrogen or $R^{10}$; Q is a charged group or ion necessary to provide the molecule with charge neutrality, X', Z' and $R^{10'}$ respectively, can be the same as or different from X, Z or $R^{10}$, and the substituents of A, $R^{10}$ and Z contain at least two acidic groups with acid dissociation constants pKa<7. Carboxylic and sulfonic acids are typical examples of such groups.

In Table III, M has the definition as noted above.

TABLE III

| Dye Compound | |
|---|---|
| III-1 | 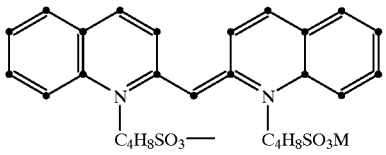 |
| III-2 | 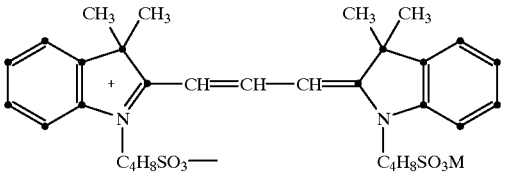 |
| III-3 | 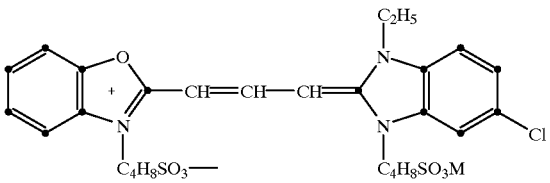 |

TABLE III-continued
| Dye Compound | |
|---|---|
| III-4 | 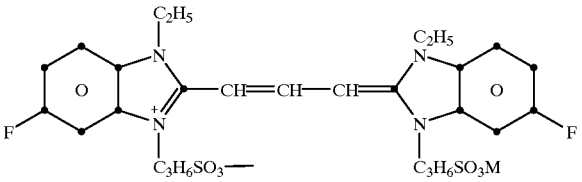 |
| III-5 | 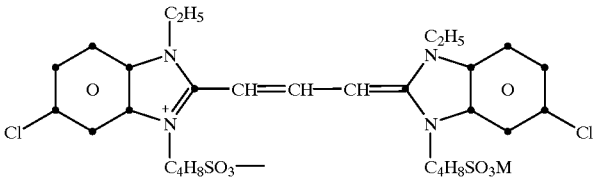 |
| III-6 | 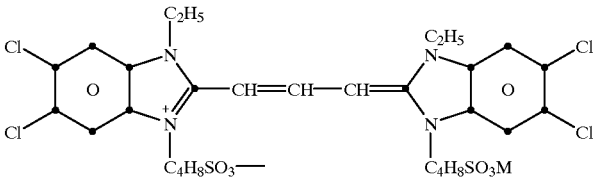 |
| III-7 | 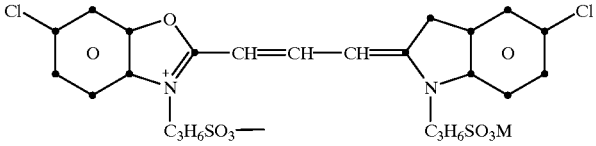 |
| III-8 | 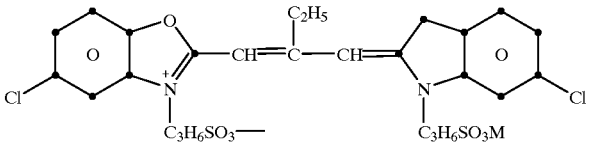 |
| III-9 | 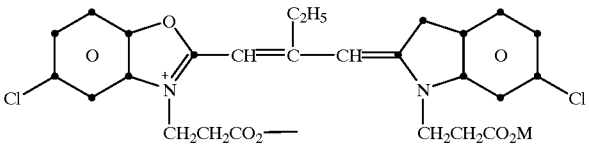 |
| III-10 | 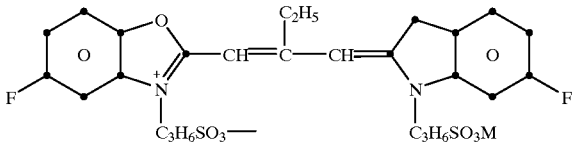 |
| III-11 | 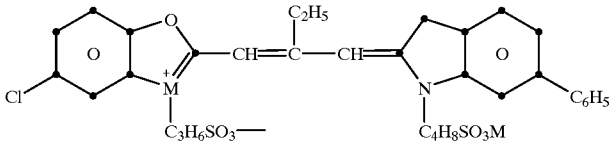 |

TABLE III-continued

| Dye Compound | |
|---|---|
| III-12 | 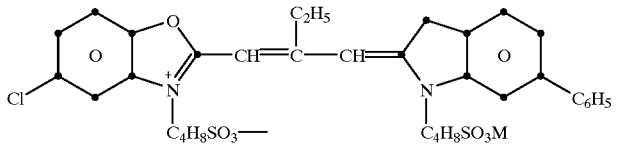 |
| III-13 | 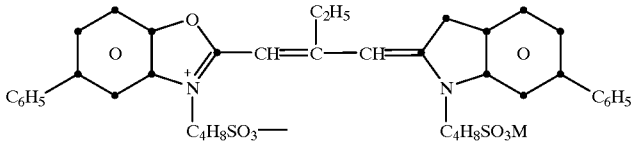 |
| III-14 | 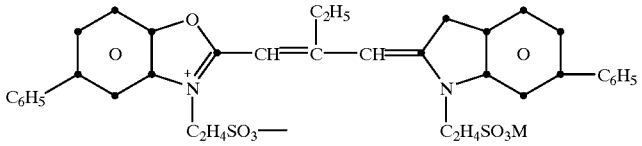 |
| III-15 | 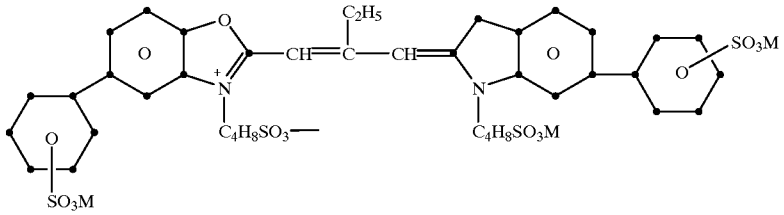 |

The following examples demonstrate the unexpectedly advantageous performance achieved with chemically sensitized emulsions by coating them in an environment of high proton and high silver ion concentrations, particularly in the presence of removable spectral sensitizers. Unless otherwise indicated, all parts, percents and ratios are by weight.

EXAMPLE 1

A sulfur-sensitized silver chlorobromide emulsion (88 mole % bromide) consisting of cubo-octahedral grains having a mean dimension of 0.35 microns and containing 4% by weight of ossein gelatin (IP 4.9) was used at pH 3.3. The pAg was adjusted to the value indicated below in Parts I and II at 40° C. For cases where spectral sensitizers were evaluated, they were added after pH/pAg adjustments and then digested in the emulsion for at least 10 minutes at 55° C. before coating at a weight of about 11 kg/mole Ag with coverages of about 1176 mg Ag and 4306 mg gelatin per $m^2$. The dry coating was exposed either by a spectral sensitometer or by a fixed light source from which spectral regions were selected with a blue filter (Wratten #36B, #38A), a green filter (Wratten #16B, #61), a red filter (Wratten #23A) or, as a Minus Blue source, a yellow filter (Wratten #16). The coated films were processed with development being carried out with KODAK Developer DK-50 or with an Elon-Ascorbic acid formulation.

Example 1, Part I

Silver Halide Dispersions of Example 1 at pH 3.3 Without Spectral Sensitizer

| Emulsion pAg | Relative Speed, Blue* | Contrast | Fog |
|---|---|---|---|
| 7.3 | 100 | 0.94 | 0.03 |
| 6.7 | 110 | 0.89 | 0.03 |
| 6.2 | 126 | 0.97 | 0.03 |
| 5.6 | 135 | 0.99 | 0.03 |
| 5.2 | 135 | 1.03 | 0.03 |
| 4.7 | 148 | 1.07 | 0.03 |
| 4.1 | 162 | 1.11 | 0.03 |
| 3.7 | 182 | 1.07 | 0.03 |

*These speed values as well as those noted in Example 1, Part II and in Examples 2 and 3 are normalized with respect to blue speed of the emulsion of Example 1 in the absence of spectral sensitizer.

Example 1, Part II

Silver Halide Dispersions of Example 1 at pH 3.3 With 0.4 mmole Oxonol I-14 Dye/Mole Silver

| Emulsion | Relative Speed* | | Contrast | |
|---|---|---|---|---|
| pAg | Blue | Minus Blue | Blue | Minus Blue |
| 7.3 | 100 | 8.9 | 1.03 | 0.97 |
| 6.7 | 105 | 14.8 | 1.0 | 1.0 |
| 5.6 | 110 | 240 | 1.0 | 0.99 |

-continued

| Emulsion | Relative Speed* | | Contrast | |
|---|---|---|---|---|
| pAg | Blue | Minus Blue | Blue | Minus Blue |
| 5.2 | 120 | 257 | 1.07 | 1.22 |
| 4.7 | 132 | 871 | 1.05 | 1.26 |
| 3.7 | 162 | 1950 | 0.93 | 1.54 |

Results of Example I, Part I and II

The speeds listed make it apparent that in the chemically sensitized silver chlorobromide emulsion, in the absence of any spectral sensitizer, blue speed is enhanced at pH 3.3 with growing availability of free silver ions. The indicated speed increase approaches a factor of 2 without significant contrast change and without formation of fog.

Part II also shows a substantial gain in blue speed with decreasing pAg in the presence of the oxonol dye I-14. However, the Minus Blue speed response is increased by many decades in the same pH range. Moreover, the sensitizer I-14 is decolorized during processing. Accordingly, the coatings of Part II exhibited no stain from residual sensitizing dye upon completion of the process cycle.

EXAMPLE 2

One part of the emulsion described above in Example 1 was adjusted at 40° C. to a pH of 6 and to a pAg of 7.3 (Condition A). Another part of the same emulsion was similarly adjusted to a pH of 3 and to a pAg of 4.3 (Condition B).

These silver halide emulsions were then examined with and without 0.4 mmole of an oxonol dye per mole of silver as indicated in the following table.

| Emulsion | | Oxonol | Relative Speed* | | |
|---|---|---|---|---|---|
| pH | pAg | Dye | Blue | Green | Red |
| Condition A | | | | | |
| 6 | 7.3 | None | 100 | None | None |
| 6 | 7.3 | I-2 | 89 | None | None |
| Condition B | | | | | |
| 3 | 4.3 | None | 115 | None | None |
| 3 | 4.3 | I-2 | 120 | 7.8 | None |
| 3 | 4.3 | I-17 | 132 | 33 | 1620 |

The indicated oxonol dyes provide no significant spectral response at conventional pH and pAg values. However, under a low pH and low pAg conditions in accordance with this invention, the same dyes yield appreciably improved emulsion response in the Minus Blue spectral region.

EXAMPLE 3

A silver halide dispersion of the emulsion of Example 1 was coated on cellulose acetate support at pH 3.3 with 0.4 mmole of merocyanine dye II-2 per mole of silver. The pAg values of the coatings were varied between 7.3 and 3.7. After processing as described in Example 1 results were as follows:

| Emulsion | Relative Speed* | | Contrast | | |
|---|---|---|---|---|---|
| pAg | Blue | Minus Blue | Blue | Minus Blue | Fog |
| 7.3 | 100 | 118 | 0.9 | 1.0 | 0.03 |
| 6.2 | 132 | 195 | 1.1 | 1.3 | 0.04 |
| 5.6 | 138 | 324 | 1.1 | 1.3 | 0.04 |
| 5.2 | 145 | 479 | 1.1 | 1.3 | 0.03 |
| 4.7 | 151 | 692 | 1.2 | 1.3 | 0.04 |
| 4.1 | 159 | 1020 | 1.1 | 1.3 | 0.03 |
| 3.7 | 170 | 1380 | 1.1 | 1.3 | 0.04 |

*These speed values are normalized with respect to the blue speed of the emulsion coated at pAg 7.3.

The data demonstrate that when excess soluble halide ions (high pAg) is decreased and an excess of soluble silver ions is introduced (low pAg), the emulsion's sensitivity is increased at essentially constant contrast without any fog production. Whereas increasing the silver ion activity in the emulsion containing merocyanine dye II-2 enhances the intrinsic blue sensitivity by a factor smaller than two, in the same pAg range the emulsion's response in the spectrally sensitized (Minus Blue) region is increased more than 10-fold. After processing, the coatings contained no stain from merocyanine dye II-2.

EXAMPLE 4

Silver halide dispersions of the emulsion of Example I were coated with 0.4 inmole/mole Ag of the indicated merocyanine dyes.

| Emulsion | Relative Speed(2) | | | | |
|---|---|---|---|---|---|
| Condition(1) | Dye | Blue | Green | Minus Blue | Fog |
| A | None | 100 | None | None | 0.04 |
| same | II-11 | 110 | 219 | 646 | 0.04 |
| same | II-3 | 107 | 9.5 | — | 0.04 |
| B | None | 110 | None | None | 0.04 |
| same | II-11 | 148 | 251 | 776 | 0.04 |
| same | II-3 | 118 | 355 | — | 0.04 |

(1)Emulsion conditions are described in Example 2.
(2)These speed values are normalized with respect to blue speed of the emulsion of Condition A in the absence of spectral sensitizer.

These data demonstrate that the low pH and low pAg environment of Condition B (Invention) improve the sensitivity of a chemically sensitized emulsion without formation of fog. This effect is particularly obvious with merocyanine II-3. Even merocyanine II-11, which contains a thione group and which is already a good spectral sensitizer in the conventional environment of Condition A, exhibits improved speeds in the acidic high silver ion environment of Condition B (Invention). Thus it is apparent that the presence of a dye's thione group, which might interact with excess silver ions, does not interfere with the beneficial effects of this invention.

EXAMPLE 5

Silver halide dispersions of the emulsion of Example II were coated with 0.2 mmole/mole Ag of the indicated cyanine dye.

| Emulsion | Relative Speeds[2] | | | |
|---|---|---|---|---|
| Condition[1] | Dye | Blue | Minus Blue | Fog |
| A | None | 100 | None | 0.04 |
| same | III-8 | 110 | 7.8 | 0.04 |
| B | None | 118 | None | 0.03 |
| same | III-8 | 132 | 13 | 0.03 |

[1]Emulsion conditions are described in Example 2.
[2]Speed values are normalized with respect to blue speed of the emulsion of Condition A in the absence of spectral sensitizer.

The data show that when the medium of a chemically sensitized emulsion is changed from a conventional environment (Condition A) to the acidic high silver ion environment of the invention (Condition B), use of a removable anionic cyanine dye produces a marked improvement of speed and spectral sensitivity without accompanying stain or fog formation.

The invention has been described in detail with particular reference to preferred embodiments thereof, but it will be understood that variations and modifications can be effected within the spirit and scope of the invention.

We claim:

1. A photographic recording material comprising a support and a photosensitive chemically sensitized silver halide emulsion layer, containing a sensitizing dye selected from the group consisting of oxonol dyes, merocyanine dyes, and cyanine dyes having a net negative charge, and which has a pH value between about 2 to about 5 and a pAg value between about 1 to about 4.7 wherein said dye being removable from the photographic material during processing.

2. The recording material according to claim 1 wherein the pH is from about 2 to 4 and the pAg is from 3 to about 4.7.

3. The recording material according to claim 2 wherein the chemical sensitizing agent is sulfur, gold or a mixture thereof.

4. The recording material according to claim 1 which also comprises a natural or synthetic hydrophilic colloid.

5. A photographic recording material according to claim 4 wherein the hydrophilic colloid is gelatin.

6. The photographic recording material according to claim 1 wherein the silver halide is one or more of silver chloride, silver bromide, silver iodide, silver chlorobromide, silver chloroiodide, silver bromoiodide or silver chlorobromoiodide.

7. The recording material of claim 1 wherein the sensitizing dye is present within the range of about 0.05 to 2.0 mmole/mole silver.

8. The recording material of claim 1 wherein the dye is an oxonol dye.

9. The recording material of claim 1 wherein the dye is a merocyanine dye.

10. The recording material of claim 1 wherein the dye is an anionic cyanine dye.

11. A photographic recording material comprising a support and a photosensitive chemically sensitized silver halide emulsion layer containing a sensitizing dye selected from the group consisting of oxonol dyes, merocyanine dyes, and cyanine dyes having a net negative charge, said dye being removable from the photographic material during processing, said layer containing an excess proton concentration of 10 to 0.01 mM, corresponding to pH values from 2 to 5, and an excess silver ion concentration of 100 to 0.02 mM, corresponding to pAg values from 2 to 4.7.

12. The recording material according to claim 11 wherein the pH is between 2 and 4 and the pAg is between 3.7 and 4.1.

13. The recording material according to claim 12 wherein the chemical sensitizing agent is sulfur, gold or a mixture thereof.

14. The recording material according to claim 11 which also comprises a natural or synthetic hydrophilic colloid.

15. The photographic recording material according to claim 12 wherein the silver halide is one or more of silver chloride, silver bromide, silver iodide, silver chlorobromide, silver chloroiodide, silver bromoiodide, or silver chlorobromoiodide.

16. The recording material of claim 11 wherein the dye is present within the range of about 0.05 to 2.0 mmole/mole silver.

17. The recording material of claim 11 wherein the dye is an oxonol sensitizer which is process-bleachable.

18. The recording material of claim 11 wherein the dye is a merocyanine sensitizer which is process-bleachable.

* * * * *